US006730903B2

(12) United States Patent
Kawato

(10) Patent No.: US 6,730,903 B2
(45) Date of Patent: May 4, 2004

(54) ION TRAP DEVICE

(75) Inventor: Eizo Kawato, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 10/244,534

(22) Filed: Sep. 17, 2002

(65) Prior Publication Data

US 2003/0071210 A1 Apr. 17, 2003

(30) Foreign Application Priority Data

Oct. 16, 2001 (JP) ..... 2001-318096

(51) Int. Cl.[7] ..... H01J 49/42
(52) U.S. Cl. ..... 250/292; 250/282
(58) Field of Search ..... 250/292, 282

(56) References Cited

U.S. PATENT DOCUMENTS 5,468,957 A * 11/1995 Franzen ..... 250/282

6,410,913 B1 * 6/2002 Brekenfeld et al. ..... 250/282

* cited by examiner

*Primary Examiner*—John R. Lee
*Assistant Examiner*—James J. Leybourne
(74) *Attorney, Agent, or Firm*—Westerman, Hattori, Daniels & Adrian, LLP

(57) ABSTRACT

In an ion trap device using an RF electric field to trap ions, when the amplitude of the RF voltage for generating the RF electric field is changed from a first value to a second value, it is changed according to the exponential function of time. And the time constant of the exponential function is set equal to or longer than the time constant of the resonant circuit for generating the RF voltage. Owing to this, the time necessary to change the RF voltage is shortened, and an overshoot, undershoot, or ringing of an actual RF voltage on the electrode or electrodes of an ion trap is avoided when the RF voltage setting value is changed, so that the movement of ions in the ion trap is not disturbed and the throughput of the ion trap device is improved.

6 Claims, 4 Drawing Sheets

ION TRAP DEVICE

The present invention relates to an ion trap device which uses a three-dimensional quadrupole electric field to trap ions in. Such an ion trap device can be used in a mass spectrometer or in an ion separator.

BACKGROUND OF THE INVENTION

In an ion trap device, as mentioned above, ions are trapped in a three-dimensional quadrupole electric field generated basically by combining an RF electric field and a DC electric field. One type of ion trap device is constructed by electrodes whose inner surfaces are shaped hyperboloid-of-revolution so that a rather large ion trapping space is created in the space surrounded by the electrodes. Another type of ion trap device is constructed by cylindrical and disc electrodes (Cylindrical Ion Trap) in which an ion trapping space is created around the center of the space surrounded by the electrodes. In these constructions, the electrodes are composed of a ring electrode, and two end cap electrodes placed at both ends of the ring electrodes, wherein the RF voltage is normally applied to the ring electrode. In either electrode construction, the mass to charge ratio (m/e) of an ion determines whether the ion is trapped in the trapping space in a stable manner, or whether its movement becomes unstable and it collides with the electrodes, or it is ejected from an opening of the electrodes. The theory of an ion trapping method is explained in, for example, R. E. March and R. J. Hughes, "Quadrupole Storage Mass Spectrometry", John Wiley & Sons, 1989, pp. 31–110.

The ion stability condition in which an ion is trapped in a stable manner in the three-dimensional quadrupole electric field is shown by the region of $0<\beta_r<1$ and $0<\beta_z<1$ in FIG. 1. The parameter of the ordinate $a_z$ and that of abscissa $q_z$ are represented by the following equation:

$$a_z = -\frac{8eU}{mr_0^2\Omega^2} \tag{1}$$

$$q_z = \frac{4eV}{mr_0^2\Omega^2}$$

where U is the magnitude of the DC voltage, V is the amplitude of the RF voltage, Ω is the angular frequency of the RF voltage, $r_0$ is the dimension of the ring electrode (precisely, its radius at the center), m is the mass of the ion, and e is the electrical charge of the ion.

In many of the recent mass spectrometers using an ion trap device (ion trap mass spectrometers), ions are trapped in such an operation mode that the DC voltage (U) is not applied but the RF voltage (V) is solely applied. In this case, the above-mentioned parameters are on the $q_z$ axis or $a_z=0$. As seen from FIG. 1, only ions whose mass to charge ratio (m/e) corresponds to the value of $q_z$ less than 0.908 can be trapped in the ion trapping space in a stable manner.

Ions are trapped in the ion trapping space as follows. In one method, an electron beam or the like is injected into the ion trapping space so that ions are created in the ion trapping space. In another method, ions are created outside and introduced in the ion trapping space. In any case, only appropriate ions are trapped there and gathered to the center of the ion trapping space with a cooling gas filled in the ion trapping space.

FIG. 2 illustrates an ion analyzing method using a mass selective instability mode (ibid. p.330). First, ions are introduced and cooled (I). Then the RF voltage V is gradually increased (II). As it increases, ions of smaller mass to charge ratios become unstable, and some of these ions are ejected from an opening formed in an electrode. The ejected ions are detected and the amount (or the strength of the detection signal) is plotted against the RF voltage, which produces a mass spectrum (mass analysis).

FIG. 3 shows an MS/MS analyzing method in which the RF voltage is changed in a rather complicated manner (ibid. p.371). Ions are generated in the stage (I), and unnecessary ions of lower mass to charge ratios are eliminated in the stage (II). At this time, ions to be analyzed (precursor ions) are trapped in the ion trapping space. Then the RF voltage is lowered in the stage (III) to obtain the mass spectrum of fragment ions. At this time, the secular frequency of the precursor ions left in the ion trapping space is calculated. In the following stage (IV), an auxiliary RF voltage having the same frequency as the secular frequency of precursor ions is applied to the end cap electrodes. The auxiliary RF voltage creates a dipole electric field in the ion trapping space so that the precursor ions are excited and fragment ions are generated. As the RF voltage is gradually increased in the stage (V), the mass spectrum of the fragment ions is obtained.

In the above example, the ion trapping electric field is changed to select precursor ions. In another method, a special waveform of auxiliary voltage is applied to the end cap electrodes and the precursor ions are selected at high resolution (for example, in the U.S. Pat. Nos. 4,761,545 and 5,134,826). In such a method, the RF voltage is usually maintained constant with high accuracy. If there is an error in the RF voltage, secular frequency of the ions deviates from the original value and high resolution cannot be achieved. If the movement of the ions is not adequately cooled within a reasonable period of time before they are separated, there arises a discrepancy of the secular frequency of the ions and high resolution cannot be achieved, either.

When the RF voltage is intended to be changed and the setting value of the RF voltage is instantly set at the controller side, the actual voltage applied to the ring electrode cannot follow the quick change and it takes some time until the actual voltage reaches the setting value. Especially when the RF voltage is abruptly set to a lower value, a large undershoot occurs in the actual RF voltage. This disturbs ion's stability in the ion trapping space and some of the ions are lost, which deteriorates the sensitivity and reproducibility of the analysis.

In actual analyzers, a resonant circuit having a high Q value is formed including the capacitance between the electrodes and an external coil. Using such a resonant circuit, a high RF voltage for trapping ions is generated from a rather low RF driving voltage. When the RF voltage is stable, the loss in the resonant circuit due to its resistance and the power supplied to it from the RF driving circuit are balanced. When the setting value of the output voltage of the RF driving circuit is abruptly changed in this state, the balance is lost, and the actual RF voltage applied to the ring electrode approaches the setting value with the time constant proper to the resonant circuit. The time constant of the resonant circuit is about 100 μsec, and it increases as the Q value is increased.

When the setting value of the RF voltage is changed, the output voltage of the RF driving circuit does not become constant. Thus a feedback control is performed so that the monitored value of the actual RF voltage is equal to the setting value. When, for example, the setting value of the RF voltage is abruptly decreased, the actual voltage on the ring electrode cannot follow the change, and monitored value remains unchanged at first. This renders a large discrepancy between the monitored value and the setting value, which brings the output voltage of the RF driving circuit to zero. Then the RF voltage of the ring electrode decreases with the time constant of the resonant circuit. When the actual RF voltage approaches the setting value, the output voltage of the RF driving circuit begins to increase. The actual RF voltage once passes the setting value to a lower value, and then it bounces back and surpasses the setting value. This causes the output voltage of the RF driving circuit to decrease. Thus an undershoot or ringing occurs in the actual RF voltage, and the movement of the ions in the ion trapping space is disturbed. It takes a long time before the actual RF voltage, as well as the output voltage of the RF driving circuit, becomes stable.

In one method of avoiding such a problem associated with a feedback control, the setting value of the RF voltage is changed not abruptly but on a moderate slope to a target value. If the slope is moderate enough, the output of an error amplifier which compares the monitored value of the actual RF voltage with the setting value does not become too large. This eliminates an undershoot in the actual RF voltage, and prevents disturbing and losing ions in the ion trapping space. When the output voltage of the RF driving circuit is made to zero, the actual RF voltage V(t) of the ring electrode approaches to zero exponentially with the time constant $\tau$ of the resonant circuit, as follows.

$$V(t) = V(t_0)\exp\left(-\frac{t-t_0}{\tau}\right) \tag{2}$$

According to the above equation (2), the changing rate of the RF voltage changes from $-V_1/\tau$ to $-V_2/\tau$ while the RF voltage is decreased from $V_1$ to $V_2$. If the RF voltage is to be changed on a constant slope, the slope should be inclined less than the smallest value of their absolute value, i.e., $-V_2/\tau$ in order for the error amplifier not to overshoot. If, then, the slope is set at $-V_2/T$ (where $T \geqq \tau$), for example, the time needed for the RF voltage to change from $V_1$ to $V_2$ is $$\frac{V_1 - V_2}{V_2}T = \left(\frac{V_1}{V_2} - 1\right)T \tag{3}$$

This means that the time needed to change the RF voltage increases as the value of $V_2$ decreases. It is also necessary to change the slope of the RF voltage setting according to the target value $V_2$ of the RF voltage. When the RF voltage reaches the target value $V_2$, a cooling time is further needed, which elongates the analyzing time and decreases the throughput of the system.

SUMMARY OF THE INVENTION

Thus an object of the present invention is to shorten the time necessary to change the RF voltage, and improve the throughput of the system.

Addressing the above problems, the present invention takes the following measures. In an ion trap device using an RF electric field to trap ions, when the amplitude of the RF voltage for generating the RF electric field is changed from a first value to a second value, it is changed according to the exponential function of time. And the time constant of the exponential function is set equal to or longer than the time constant of the resonant circuit for generating the RF electric field.

Owing to the above measures, the time necessary to change the RF voltage is shortened, and an overshoot, undershoot, or ringing of an actual RF voltage on the electrode or electrodes of an ion trap is avoided when the RF voltage setting value is changed, so that movement of ions in the ion trap is not disturbed and the throughput of the ion trap device is improved.

DETAILED DESCRIPTION OF A PREFERRED EMBODIMENT

Figure 1:
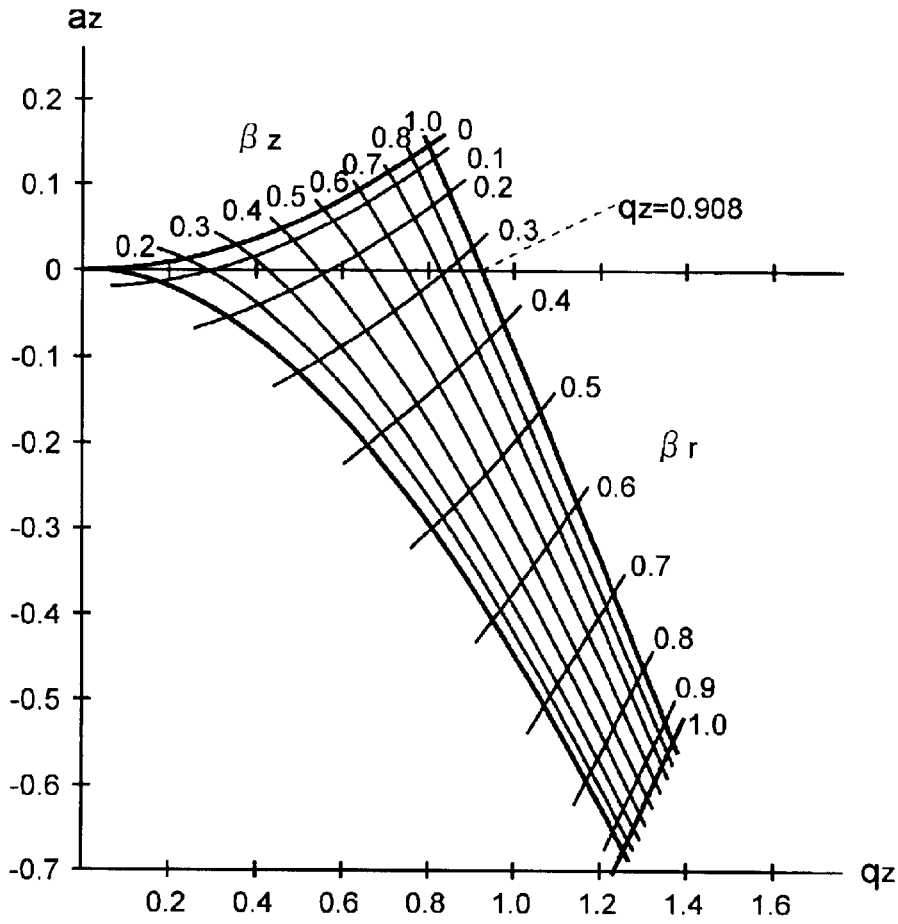
FIG. 1 is a diagram showing the stable region of an ion trap.
Figure 2:
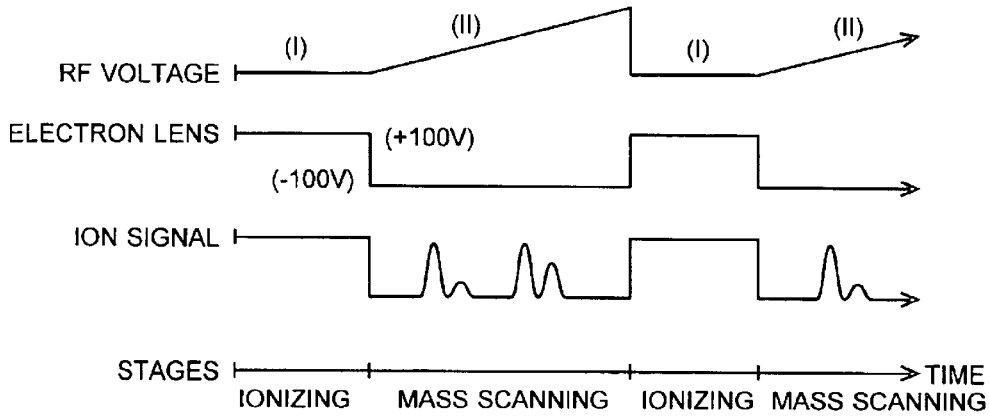
FIG. 2 is a time chart of an analysis according to the mass selective instability mode.
Figure 3:
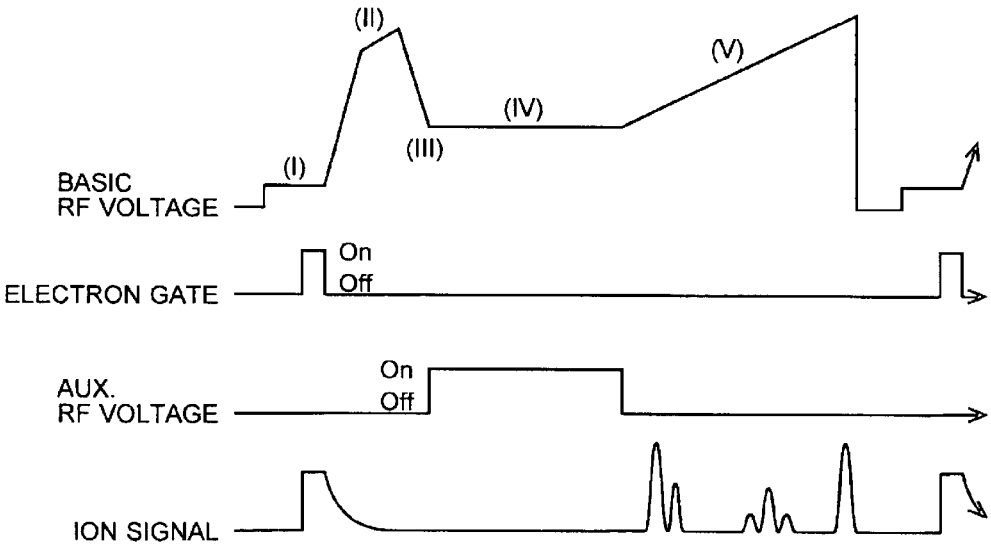
FIG. 3 is a time chart of an MS/MS analyzing method.
Figure 4:
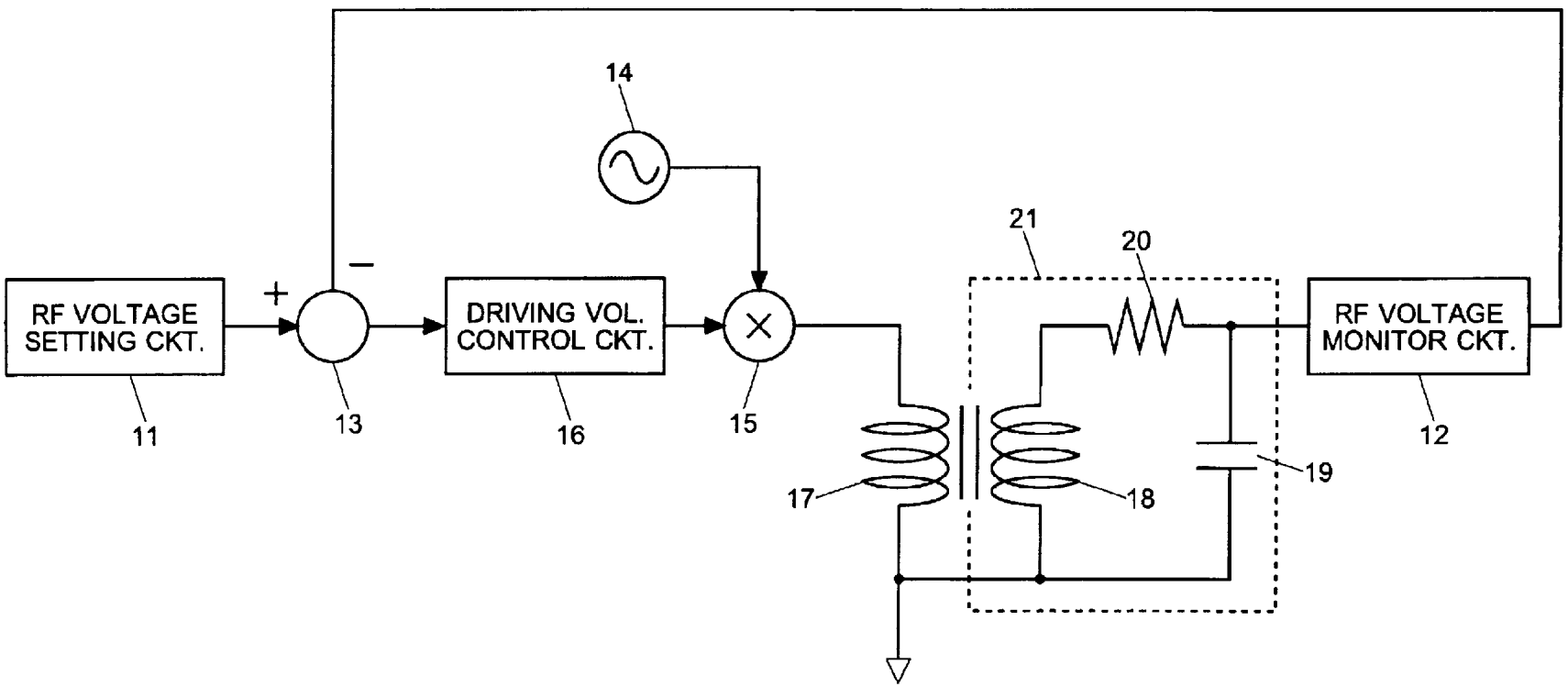
FIG. 4 is a schematic diagram of the RF voltage control circuit of an embodiment of the present invention.

FIG. 4 shows a schematic diagram of the RF voltage control circuit. The resonant circuit 21, which generates a high voltage for trapping ions in the ion trapping space, is analogously represented by a resonant coil 18, a resonant capacitance 19 and a resonant resistance 20. The resonant coil 18 represents all the inductance including that of an actual coil element and other elements of the resonant circuit 21. The resonant capacitance 19 represents all the capacitor including that between the ring electrode and the end cap electrodes, that of a variable capacitor for adjusting the resonant frequency and of other auxiliary elements and stray capacitance. The resonant resistance 20 represents all the resistance including that of the wire of the coil and the equivalent resistance due to the phase delay/advance of the coil and capacitance.

The setting value of the RF voltage is given from the RF voltage setting circuit 11, and is sent to the error amplifier 13. The actual value of the RF voltage applied to the ion trap is monitored by the RF voltage monitor circuit 12, detected, rectified and sent to the error amplifier 13, where it is compared with the setting value. From the difference or error, the drive voltage control circuit 16 generates a control signal. The control signal is multiplied in the RF driving circuit 15 with a sinusoidal wave generated by the reference RF frequency generating circuit 14. The resultant signal is amplified and sent to the driving coil 17. The driving coil 17 is magnetically coupled with the resonant circuit 21, and controls the RF voltage on the ring electrode. When, therefore, a certain value of an RF voltage is set, an RF voltage whose amplitude is proportional to the setting value is generated at the input of the RF voltage monitor circuit 12. At this time, the gain of the difference between (the amplitude of) the setting value and the actual RF value is determined by the RF voltage monitor circuit 12.

In order to assure a stable action of the feedback control of the RF driving circuit, it is important to prevent the error amplifier 13 from receiving an excessive input. When, for example, the actual RF voltage (or the input to the RF voltage monitor circuit 12) is $V_1$, and the output voltage of the RF driving circuit 15 is set at zero, the changing rate of the RF voltage is $-V_1/\tau$. This is the maximum value (of the absolute value) of the changing rate of the RF voltage, and, when it is converted with the gain, it gives the maximum value of the changing rate of the RF voltage setting value.

If the RF voltage setting value is changed slower than this maximum rate, the actual RF voltage can follow the change in the setting value, and the error amplifier 13 does not undergo an excessive input. If, on the other hand, the RF voltage setting value is changed faster than the maximum rate, the actual RF voltage cannot follow the change, and the error between the setting value and the monitored value gradually increases. Ultimately, the error integral circuit of the drive voltage control circuit 16 may be saturated.

Figure 5:
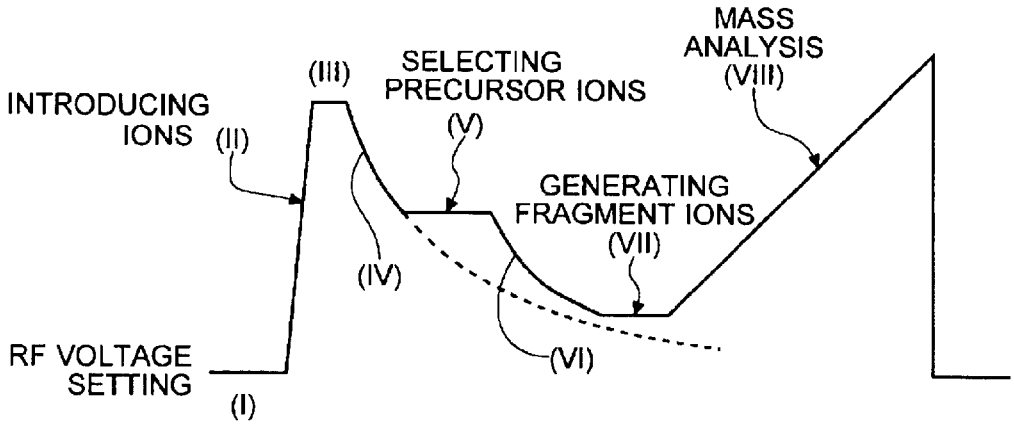
FIG. 5 is a time chart of an analysis according to the embodiment.

In the present embodiment, as shown in FIG. 5, the setting value is changed according to the exponential function of time. Owing to that, the actual RF voltage is changed in a stable manner and at high speed. FIG. 5 shows the change in the RF setting voltage in an MS/MS analysis.

Before ions are introduced (I), the RF voltage is set at zero or near-zero value in order to eliminate ions generated in a previous analysis. When ions are introduced (II), the RF voltage is instantly set at a high value. For this setting, the method described in the International PCT Publication WO 00/38312 (PCT/GB98/03856) can be used. According to the method, the RF voltage on the ring electrode and the RF setting voltage are simultaneously raised. Since the error between the setting value and the monitored value is small, the actual RF voltage is controlled in a stable manner.

When the trajectories of ions become stable owing to the cooling after the ion introduction (III), the RF voltage is changed to select precursor ions (IV). In this stage, the secular frequency of the precursor ions is the same as the frequency of the ion selecting waveform. For changing the RF voltage setting value, an exponential function is accorded whose time constant is slightly larger than that $\tau$ of the resonant circuit 21.

When the RF voltage becomes stable, an electric field for selecting ions is generated, and the precursor ions are selected (V). Then the RF voltage is further changed to generate fragment ions (VI). This time the RF voltage is also changed according to an exponential function. Since the mass to charge ratios of the fragment ions are normally smaller than that of precursor ions, the RF voltage for generating fragment ions is set lower in order to trap a wider range of fragment ions (VII).

Then the RF voltage is changed (or scanned) at a constant rate (VIII) to produce a mass spectrum using the mass selective instability method or the resonant ejection method.

When the RF voltage setting value is decreased from $V_1$ to $V_2$ ($V_2<V_1$) according to the exponential function with the time constant T, the time needed to change the actual RF voltage from $V_1$ to $V_2$ is $T\times\ln(V_1/V_2)$. If $V_2=0.3V_1$, the time is 1.20T.

When, on the other hand, the RF voltage setting value is changed linearly, the time needed to change the actual RF voltage from $V_1$ to $V_2$ is 2.33T, according to the equation (3). Thus, the time needed to change the actual RF voltage is shortened to about a half by using the exponential function.

In the present embodiment, ions are successively ejected from the ion trapping space by gradually changing (or scanning) the RF voltage on the ion trap, and a mass spectrum is obtained. An ion trap is also used in combination with a TOF mass analyzer where ions are extracted from the ion trap and are detected by the TOF analyzer. In this case, too, the RF voltage may be changed according to the exponential function when it is applicable or needed to be changed in various stages of process, whereby the processing time is shortened and the throughput is improved.

In the above description of embodiment, the RF voltage is changed according to the exponential function when it is decreased. It is of course effective when the RF voltage is increased according to the exponential function. In this case, an overshoot or ringing of an actual RF voltage when it reaches the setting value is avoided, and ions can be held in a stable manner.

The output of the driving circuit is given to the resonant coil with a magnetic coupling in the above embodiment. It is possible instead to give the output of the driving circuit directly to the resonant coil.

What is claimed is:

1. An ion trap device for trapping ions in an ion trapping space surrounded by a ring electrode and a pair of end cap electrodes placed at both ends of the ring electrode, the ion trap device comprising:

an RF voltage generator for applying an RF voltage to at least one of electrodes surrounding the ion trapping space to produce a trapping field therein;

an RF voltage controller for controlling the driving circuit of the RF voltage; and RF voltage setting means for setting an amplitude of the RF voltage according to an exponential function of time when the target amplitude of the RF voltage is changed from a first value to a second value.

2. The ion trap device according to claim 1, wherein the time constant of the exponential function is set equal to or longer than the time constant of a resonant circuit for generating the RF voltage.

3. The ion trap device according to claim 2, wherein the first value is larger than the second value.

4. A method of operating an ion trap device for trapping ions in an ion trapping space surrounded by a ring electrode and a pair of end cap electrodes placed at both ends of the ring electrode comprising the steps of:

applying an RF voltage to at least one of electrodes surrounding the ion trapping space to produce a trapping field therein; and changing an amplitude of the RF voltage according to an exponential function of time when the amplitude of the RF voltage is changed from a first value to a second value.

5. The ion trap operating method according to claim 4, wherein the time constant of the exponential function is set equal to or longer than the time constant of a resonant circuit for generating the RF voltage.

6. The ion trap operating method according to claim 5, wherein the first value is larger than the second value.

* * * * *